United States Patent [19]

Foster et al.

[11] Patent Number: 4,823,776

[45] Date of Patent: Apr. 25, 1989

[54] ADJUSTABLE CRANIAL HEAD SUPPORT

[76] Inventors: J. W. Foster; W. June Foster, both of 1049 Jamestown Crescent, Norfolk, Va. 23508

[21] Appl. No.: 148,481

[22] Filed: Jan. 26, 1988

[51] Int. Cl.[4] ..... A61H 1/00

[52] U.S. Cl. ..... 128/33; 5/421; 5/434; 5/439; 5/441; 128/76 R

[58] Field of Search ..... 128/33, 69, 62 R, 76 R; 5/431, 435, 434, 439, 421, 441

[56] References Cited

U.S. PATENT DOCUMENTS

| | | | |
|---|---|---|---|
| 2,551,727 | 5/1951 | Costello | 5/435 |
| 2,634,435 | 4/1953 | Budd | 5/435 |
| 3,913,155 | 10/1975 | Eary, Sr. | 5/435 |
| 4,504,050 | 3/1985 | Osborne | 5/435 X |
| 4,583,255 | 4/1986 | Mogaki et al. | 128/33 X |
| 4,711,230 | 12/1987 | Berke et al. | 128/69 |

*Primary Examiner*—Edgar S. Burr
*Assistant Examiner*—Moshe I. Cohen
*Attorney, Agent, or Firm*—John K. Donaghy

[57] ABSTRACT

An adjustable head support comprising a base support having a lower rail and an upper rail; said lower rail for engaging a support surface such as a mattress; said upper rail having a first means for adjustably supporting a pad upon which patient's chin rests and having a second means for adjustably supporting a pad upon which a patient's forehead rests, and said pads having hydraulic means to ensure maximum comfort of a patient while lying in the prone position.

14 Claims, 4 Drawing Sheets

FIG. 5
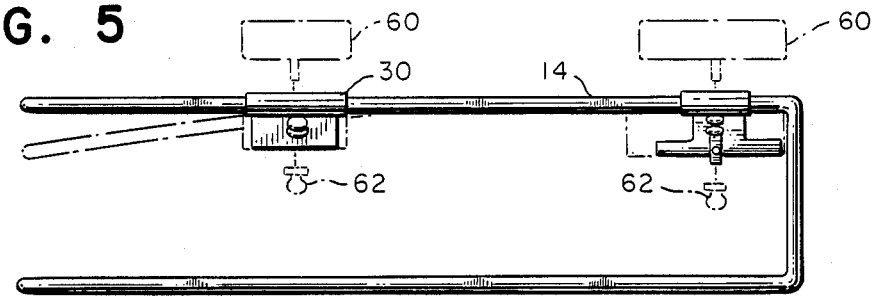
FIG. 6
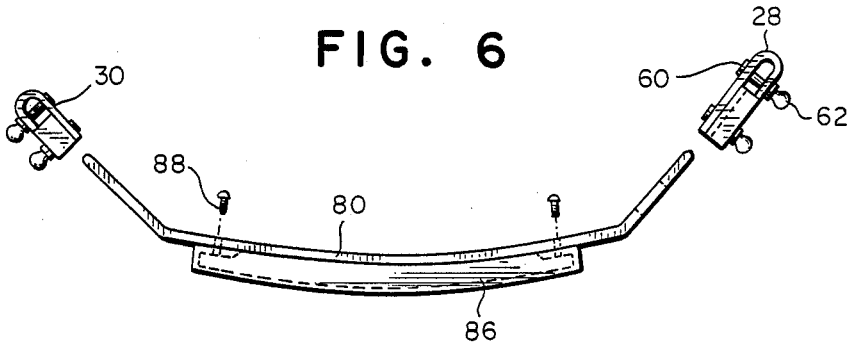
FIG. 7
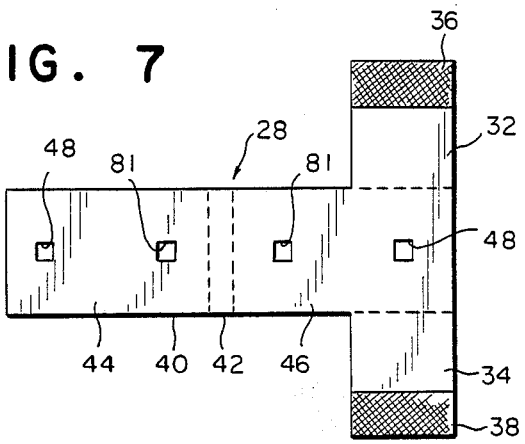
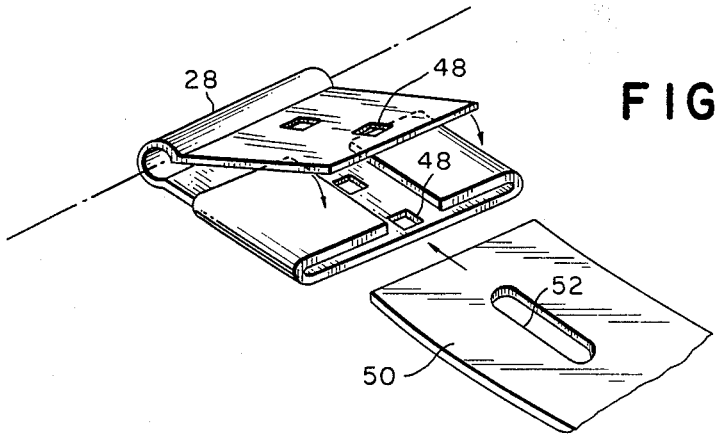
FIG. 8

FIG. 9
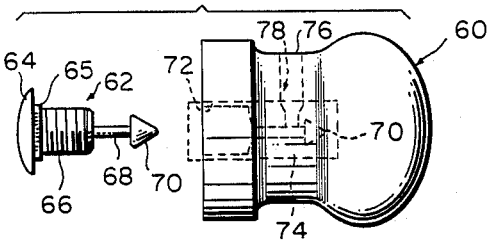
FIG. 10
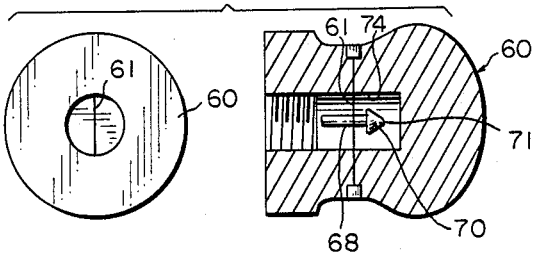
FIG. 11
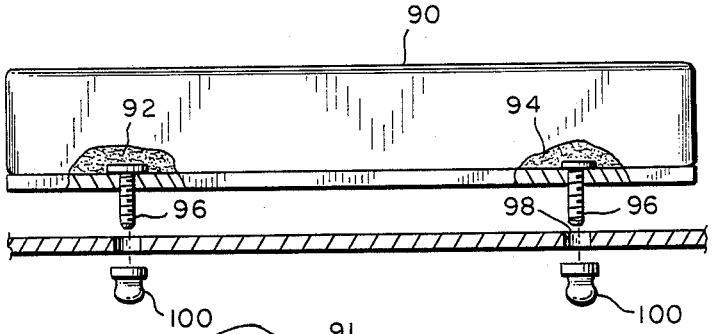
FIG. 12
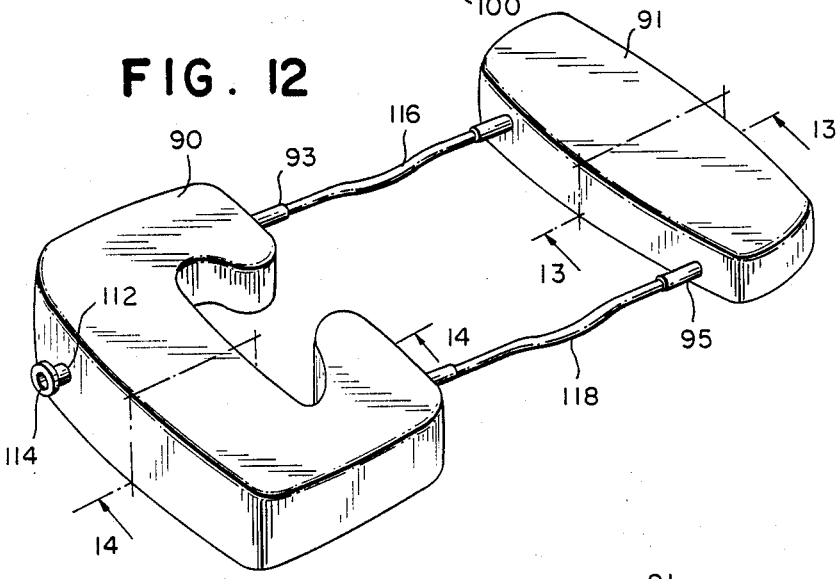
FIG. 13
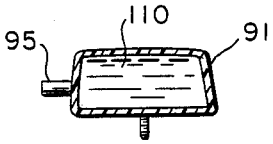
FIG. 14
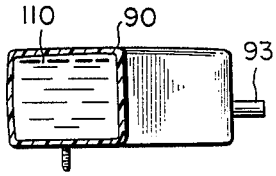
FIG. 17
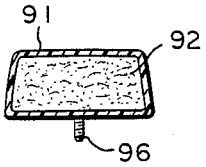
FIG. 16
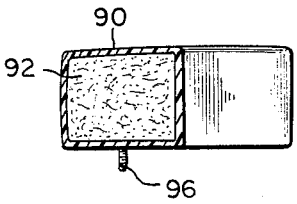
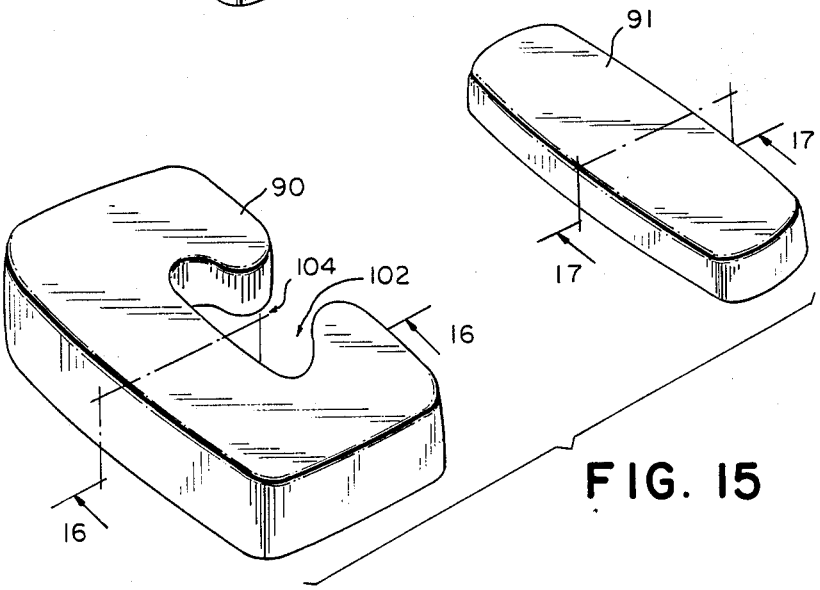
FIG. 15

ADJUSTABLE CRANIAL HEAD SUPPORT

BACKGROUND OF INVENTION

1. Field of the Invention

This invention pertains to an adjustable cranial support device which provides the vitrectomy patient with as comfortable a head support as possible for the duration of the number of days the patient is required to lie in a prone position following surgery or other procedures.

2. Prior Art

The prior art shows various designs of head supports for use by patients who must lie in a prone position.

Wynkoop (U.S. Pat. No. 2,803,022) shows such a device. In addition to providing a head support, the device also provides areas for supporting the upper body. Treace (U.S. Pat. No. 3,694,831) discloses a head support constructed from foam material and includes a base portion 15 and a pair of pads 33, 35 supported on the base portion. Eary (U.S. Pat. No. 3,828,377) shows an adjustable body support having a face support 6 and shoulder rests 4, 5 supported on base 2. Eary (U.S. Pat. No. 1,913,155) discloses an adjustable head and shoulder rest comprising shoulder rests 6, 7 and face rests 3, 4 and 5 and Osborne (U.S. Pat. No. 4,504,050) shows a head support 8 mounted for movement on flanges 6 and 7.

None of these patents show a simplified flexible, lightweight, stainless steel frame having laterally and longitudinally adjustable pad-supporting straps which ensure the vitrectomy patient of optimum head support while lying in the prone position after surgery or other procedures.

SUMMARY OF THE INVENTION

There is a need for a simple, inexpensive, portable support which ensures the most comfortable head support for a patient while lying in the prone position.

It is, therefore, one object of this invention to provide a head support for a patient which is designed to permit access to a patient's eyes, nose and mouth without disturbing immobilization of the head, and, at the same time, allow the patient to have breathing room while lying in a prone position after vitrectomy surgery.

Another object of this invention is to provide a head support having a unique, flexible, lightweight, stainless steel frame which provides a floating effect for a patient's head while the patient is lying in a prone position.

Yet another object of this invention is to provide the frame with adjustable straps for supporting removable pads upon which a patient's chin and forehead rests.

Still another object of this invention is to provide unique fastening means for permitting adjustment and securement of the pad-supporting straps on the frame.

Another object of this invention is the provision of chin and forehead supporting pads which comprise plastic shells filled with antiseptic gel, thus providing soft, resilient supports for a patient's head.

A further object of this invention is the utilization of fluid-filled pads instead of the gel-filled plastic shell and the provision of interconnecting means for the fluid-filled pads whereby the fluid may circulate between the chin-supporting pad and the forehead-supporting pad.

A special object of this invention is to provide temperature regulating means for said fluid-filled pads to ensure critical temperature control for the circulating fluid.

Yet another special object of this invention is to provide the fluid-filled pads with sonic application means to control the frequency and intensity of tissue/sensory stimulation.

These and other objects of the invention will become apparent to those skilled in the art to which the invention pertains from a reading of the following specifications when taken in light of the annexed drawings.

BRIEF DESCRIPTION OF THE DRAWINGS

FIG. 5 is a side view of the frame showing the fastening means which permit adjustment of the straps telescopically of each other and longitudinally along the rail of the upper frame portion.

FIG. 6 is a side view of a supporting strap with reinforcing means for preventing dishing of the strap by the weight of a patient's head.

FIG. 7 is a plan view of the strap connecting portion in folded-out form.

FIG. 8 is a perspective view of the strap connecting portion folded to form a connection for the end of the strap.

FIG. 9 is a side view in section of the bolt and nut securing means with a set-screw in position to prevent the bolt from being turned out of the socket.

FIG. 10 is a view similar to that of FIG. 9 showing an alternative means for retaining the bolt in the nut.

FIG. 11 is a side view of the means for securing the supporting pads to the supporting straps.

FIG. 12 is a perspective view of fluid-filled supporting pads interconnected by hollow tubes.

FIG. 13 is a side-section view of a chin-supporting pad taken along the line 13—13 of FIG. 12.

FIG. 14 is a side-section view of a forehead-supporting pad taken along the line 14—14 of FIG. 12.

FIG. 15 is a perspective view of the antiseptic gel-filled supporting pads.

FIG. 16 is a side-section view of the chin-supporting pad taken along the line 16—16 of FIG. 15.

FIG. 17 is a side-section view of the forehead-supporting pad taken along the line 17—17 of FIG. 15.

DETAILED DESCRIPTION OF THE PREFERRED EMBODIMENT OF THE INVENTION

Figure 1:
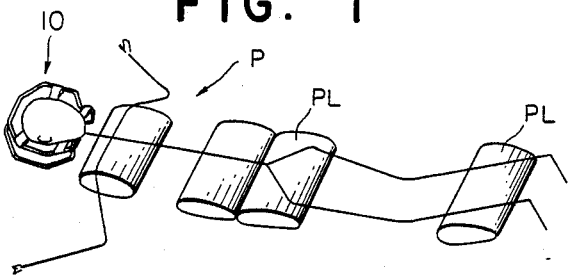
FIG. 1 is a perspective view of a female patient lying in a prone position with her head supported in the head support of this invention.

Referring now in more detail to the drawings, FIG. 1 shows a female patient P lying in the prone position, which is required following vitrectomy surgery, with her head supported in the head support device 10 of the invention. Pillows PL are used to maintain the body as close to horizontal as possible. This ensures maximum comfort for the patient and optimum support of the patient's head.

Figure 2:
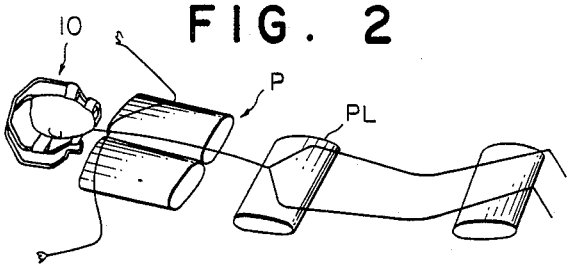
FIG. 2 is a perspective view of a male patient lying in a prone position with his head supported in the head support of this invention.

FIG. 2 shows a male patient P lying in the prone position with the head supported in the head support 10. Pillows PL are used to maintain the body as close to horizontal as possible. Any number of pillows may be used.

Figure 3:
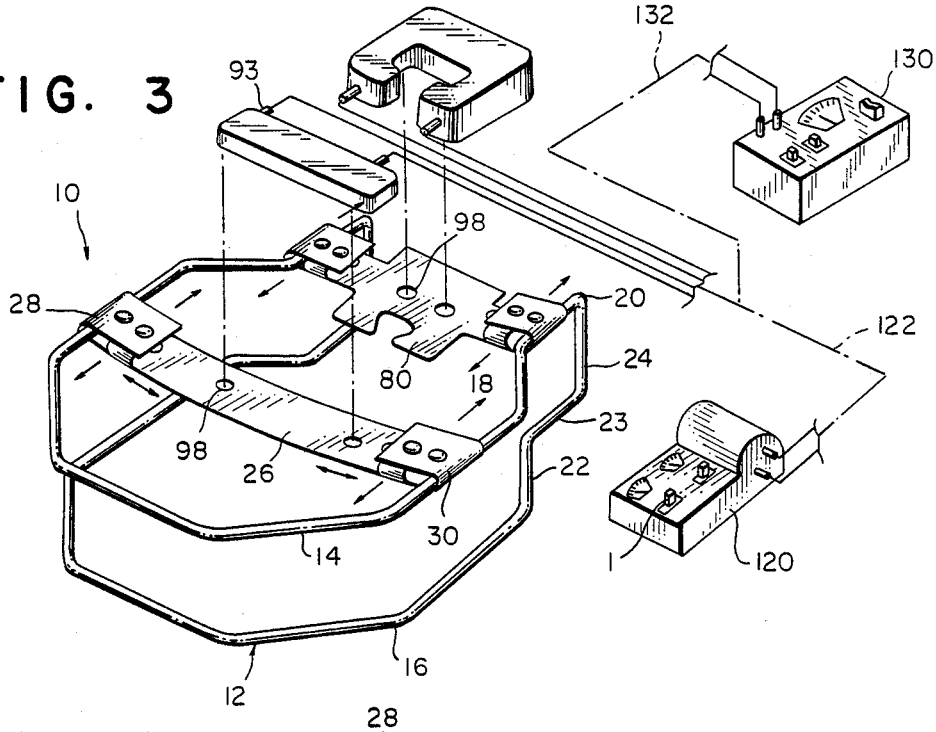
FIG. 3 is a perspective view of the invention showing the various components in exploded arrangement and showing temperature controlling means and sonic application means connected to the supporting pads.

In FIG. 3 there is shown a head support 10 which includes a base portion 12 comprising an upper rail portion 14 and a lower rail portion 16. The upper rail portion 14 has an oblique leg 18 and a horizontal arm 20. The lower rail portion 16 has an oblique leg 22 and a horizontal arm 23 which is parallel to and spaced a distance from the common connecting rod 24. It will be understood that the rails 14 and 16 are continuous, being constructed from a single piece of stainless steel heavy duty wire. It also will be appreciated that configuration of the legs opposite 18, 20, 22, 23, and 24 is exactly the same.

Supported on the upper rail portion 14 is a strap 26 having end connectors 28, 30. The connectors 28, 30, FIG. 7, are made from a T-shaped flat stainless steel metal having short arms 32, 34, and having knurled surfaces 36, 38 at the outer ends. The long arm 40 has scribe lines 42 for ease of location of bending the outer half 44 around the mandrel (whose diameter equates to that of the support frame) and over the inner half 46. Each half 44, 46 has square holes 48, which, when the halves overlay each other as in FIG. 8, are aligned over each other and the knurled ends will engage the ends 50, one shown, of the strap 26. When the end 50 is inserted in the connector 28, FIG. 8, the slots 52 will lie between the sets of square holes 48. To secure the ends 50 in the connectors 28, 30 the nut 60 and bolt 62, having square shoulders to mate with the square holes, are used. The bolt 62 comprises a rounded outer end 64, larger in diameter than the square holes 48, a square shoulder 65, a threaded shank 66, a reduced portion 68 and an arrow-like end 70. The nut 60 has a threaded bore 72, and a chamber 74 with a transverse threaded bore 76 for screwing a setscrew 78.

Figure 4:
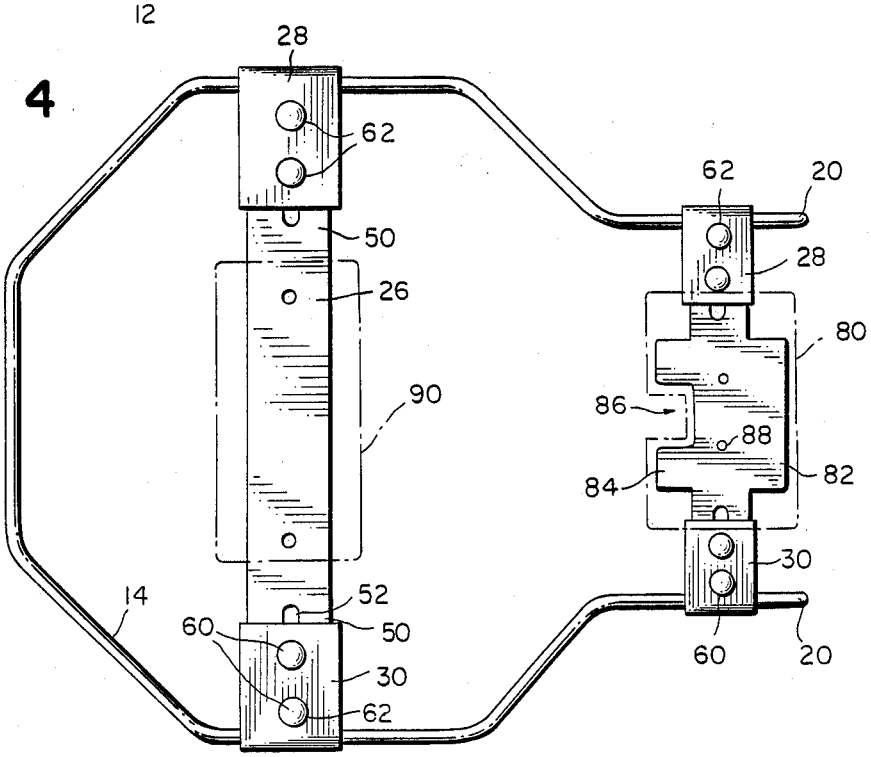
FIG. 4 is a bottom view of the upper portion of the frame showing the adjustable straps attached thereto.

As seen in FIGS. 4–6, the connectors 28, 30 are slidably mounted on the rail 14 opposite each other. The ends 50 of the strap 26 are telescoped in the connectors such that the slots 52 lie between the holes 48. The bolt 62 with square shoulder 65 is inserted through the square holes 48 and slots 50 and tightened such that the knurled surfaces bite against the ends of the strap. Once tightened, the set-screw 78 is turned in and abutts the reduced portion 68 behind the arrow-like end 70 to lock the bolt in place. It will be seen that the strap may be adjusted inwardly or outwardly of the connectors 28, 30 by loosening the nut and bolt. This provides for adjustment of the height of a patient's head above the mattress, not shown. The desired height of the patient's head is one inch to one and one half inches above the mattress. The other set of square holes 81 receive a similar nut 60 and bolt 62 which, when tightened, secure the connectors 28, 30 to the rail 14. In order to permit longitudinal movements of the connectors along the rail 14, it is only necessary to loosen the nut and bolt, FIG. 5.

An alternate form of bolt retaining means is shown in FIG. 10. The nut 60 has a wire 61 passing through the chamber such that its point of contact with the bolt 62, not shown, is the point 71 of the arrow-like end 70. It will be appreciated that the taut wire 61 moves outwardly as the arrow passes inwardly of the chamber 74. Once beyond the widest end of the arrow, the wire springs inwardly and abutts the reduced portion 68 thus maintaining the bolt in place. There is sufficient distance from the set-screw, on the one hand, and the wire on the other, and the widest end of the arrow to allow the bolt to be turned out of the bore 72 to make the necessary adjustments.

Fastened to the rail 14 on legs 20 near the leg 24 is a second strap 80, FIGS. 3, 4 and 5, secured by a nut and bolt 60, 62 similar to that of strap 26. The strap 80 is larger in width than strap 26, having extensions 82, 84. The extension 84 is notched to form an opening 86. A pair of holes 88 will receive the shank portions of bolts to secure a support pad to the strap 80 to be explained in more detail below.

It will be appreciated that the strap 80 may be adjusted telescopically in connectors 28, 30 and longitudinally along the legs 20 by loosening nuts and bolts 60, 62. The strap 80 has a reinforcing strip 86, FIG. 6, secured thereto by fasteners such as bolts or rivets 88. This reinforcing is important to prevent dishing of the strap 80 by the weight of a patient's head.

The supporting pads 90 and 91, one shown, FIGS. 11–16, comprise a plastic shell filled with antiseptic gel 92 to form a pneumatic or hydraulic support for a patient's forehead and chin. The pad 90 has one end of a bolt 94 secured inside the shell with the threaded shank portion 96 extending through the holes 98 in the straps 26. Nuts 100, secured in support straps 101 which are fastened at one end to the straps 26 by rivets 103, secure the bolts and pads to the straps 26. The straps 101 retain the nuts 100 at a location near holes 96.

FIG. 15 shows the pads 90, 91 in spaced-apart relationship as they would appear when secured to straps 80 and 26 respectively. Pad 90 is notched to form an opening 102 for the mouth of a patient and an opening 104, for the nose. It will thus be apparent that access to the patient's mouth and nose may be had through these openings without moving the patient's head.

FIGS. 16 and 17 shows the cross-sectional views of the forehead-supporting pad 91 and the chin-supporting pad 90 respectively, with the shank portion 96 of bolts 94.

The pads 90 and 91 may be factory-filled and sealed with an antiseptic gel, FIGS. 15–17, or filled with an antiseptic fluid 110, FIGS. 12–14, through fill hole 112 having cap 114. The fluid-filled pads 90 and 91 have interconnecting tubes 116, 118 whereby the fluid may circulate between the pads for heat transfer as well as pressure equalization. The fluid circulating through pads 90, 91 may be heated or cooled by circulating pump 120, FIG. 3. The circulating pump 120 incorporates not only a rotary circulating pump for circulating the pad fluid, but also a heat exchanger for cooling the pad fluid by means of an outside source (e.g. commercial chilled-water devices or tap water) and thermostatically controlled heating elements for precise control of the pad fluid temperature.

The circulating pump 120 will have batteries when used away from conventional electric sources and plug, not shown, to connect it to a conventional source of electricity.

Further, the pads 90, 91 may be attachable to a sonic transducer 130 having lines 132 connected to a suitable receiver inside the pads to cause sonic vibrations to the pads to produce tissue/sensory stimulation. This application is especially useful for paralyzed patients.

Figure 19:
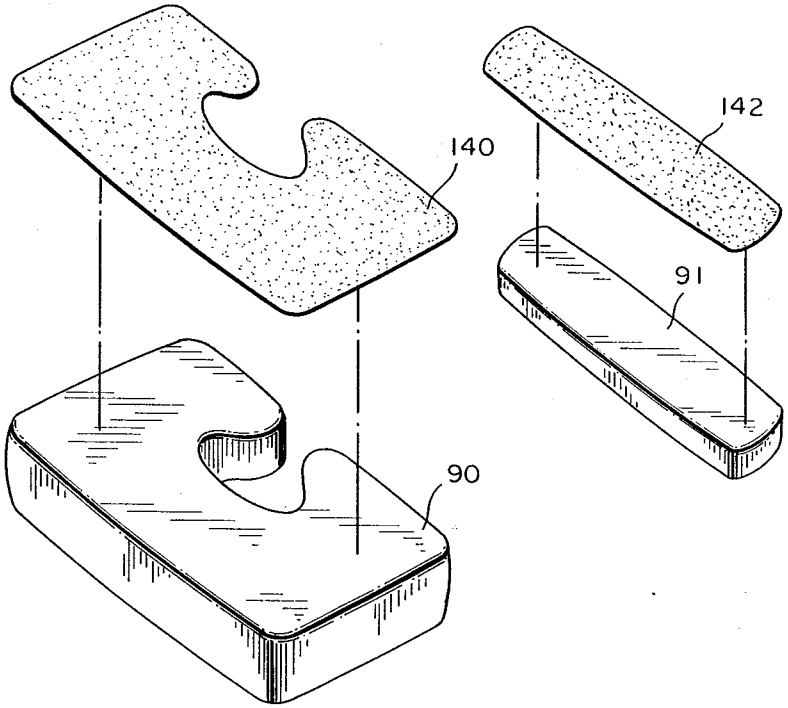
FIG. 19 is an exploded perspective view of the supporting pads and disposable air breathing pads.
Figure 18:
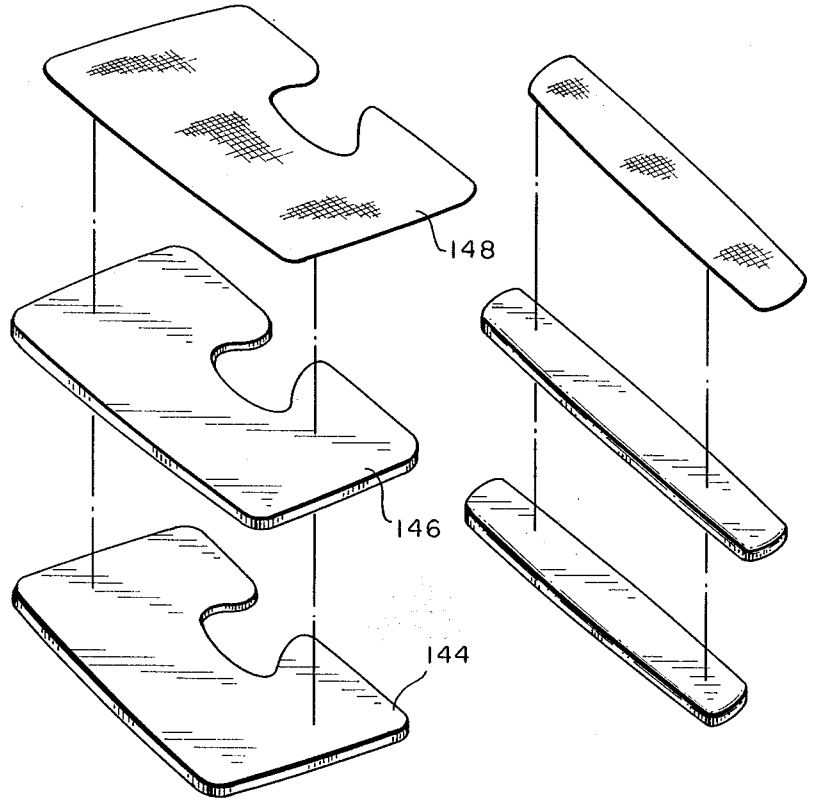
FIG. 18 is an exploded perspective view of a disposable adhesive-backed air breathing pad removably attached to the forehead and chin-supporting pads.

The pads 90, 91, FIG. 19, will be covered with disposable sanitary covers 140, 142 for patient comfort and protection. These sanitary covers comprise a bottom layer 144, only one pad to be discussed, having an adhesive coating for attachment to the pads 90, 91, an intermediate moisture-absorbing layer 146, and outer face-engaging layer 148. This layer 148 may be a soft breathable material of a suitable type. The layers 144–148 are secured together to form a one-piece disposable cover, FIG. 19. The covers permit air circulation between the patient's skin and the pads. The pads 90, 91 are of a composition that can be put into a gas sterilizer and thus are reusable.

The unique adjustment features of the chin and forehead support pads provides for pre-surgery fitting of the head support to the precise dimensions of the patient's face.

While the invention has been described with respect to the preferred embodiment thereof, it will be appreciated by those skilled in the art to which the invention pertains, that numerous changes may be made therein without departing from the spirit and scope thereof.

What is claimed is:

1. An adjustable head support for ensuring passive immobilization of a patient's head while the patient is lying in a prone position comprising:

a base support having a lower rail and an upper rail;

said lower and upper rails formed from a continuous piece of wire bent into a pair of multi-sided shapes arranged in lower and upper parallel planes, and having one side of each lower and upper multi-sided shapes open, with short horizontal wire portions on the open sides of said shapes extending away from said shapes and parallel to the spinal axis of a patient utilizing said adjustable head support and in the same planes as said multi-sided shapes, said short horizontal wire portions of said lower and upper multi-sided shapes being interconnected by short vertical portions of said continuous piece of wire such that a spring hinge action is effected between said lower and upper rails, said spring hinge action having an effective pivot point near the base of the patient's neck;

said lower rail for engaging a support surface such as a mattress; and said upper rail having a first means for adjustably supporting a pad upon which a patient's chin rests and having a second means for adjustably supporting a pad upon which a patient's forehead rests.

2. An adjustable head support according to claim 1, wherein:

said lower rail and said upper rail are connected together such that the base support provides a floating effect for a patient's head while lying in the prone position.

3. An adjustable head support according to claim 1, wherein:

said first means for supporting a pad upon which a patient's chin rests comprises a strap laterally adjustable in connectors attached to said rail whereby the distance between said mattress to the strap may be adjusted to provide a distance of 1½ ".

4. An adjustable head support according to claim 1, wherein:

said second means for supporting a pad upon which a patient's forehead rests comprises a second strap laterally adjustable in connectors attached to said rail whereby the distance between said mattress and said strap may be adjusted and whereby the connectors may be longitudinally adjustable on said rail so that the distance between said first strap and said second strap may be set.

5. An adjustable head support according to claim 1, wherein:

said hydraulic means comprises antiseptic get in said pads ensuring maximum equalization of pressure on facial bone structure.

6. An adjustable head support according to claim 1, wherein:

said hydraulic means comprises fluid circulating between said pads by suitable tubing.

7. An adjustable head support according to claim 8, wherein:

said fluid means has heating and cooling means for regulating the temperature of said fluid circulating between said pads.

8. An adjustable head support according to claim 6, wherein:

sonic means is associated with the fluid means for applying vibratory frequency to said pads for tissue and sensory stimulation.

9. An adjustable head support for ensuring passive immobilization of a patient's head while the patient is lying in a prone position comprising:

a base support having a lower rail and an upper rail;

said lower and upper rials formed from a continuous piece of wire bent into a pair of multi-sided shapes arranged in lower and upper parallel planes, and having one side of each lower and upper multi-sided shapes open, with short horizontal wire portions on the open sides of said shapes extending away from said shapes and parallel to the spinal axis of a patient utilizing said adjustable head support and in the same planes as said multi-sided shapes, said short horizontal wire portions of said lower and upper multi-sided shapes being interconnected by short vertical portions of said continuous piece of wire such that a spring hinge action is effected between said lower and upper rails, said spring hinge action having an effective pivot point near the base of the patient's neck;

said lower rail or engaging a support surface such as a mattress; and said upper rail having a first means for adjustably supporting a pad upon which a patient's chin rests and having a second means for adjustably supporting a pad upon which a patient's forehead rests;

said first and second straps telescopically received in connectors attached to said upper rail, and said pads having hydraulic means to enhance the comfort of a patient while lying on the subject support.

10. An adjustable head support for ensuring passive immobilization of a patient's head while the patient is lying in a prone position comprising:

a base support having a lower rail and an upper rail;

said lower and upper rails formed from a continuous piece of wire bent into a pair of multi-sided shapes arranged in lower and upper parallel planes, and having one side of each lower and upper multi-sided shapes open, with short horizontal wire portions on the open sides of said shapes extending away from said shapes and parallel to the spinal axis of a patient utilizing said adjustable head support and in the same planes as said multi-sided shapes, said short horizontal wire portions of said lower and upper multi-sided shapes being interconnected by short vertical portions of said continuous piece of wire such that a spring hinge action is effected between said lower and upper rails, said spring hinge action having an effective pivot point near the base of the patient's neck;

said lower rail for engaging a support surface such as a mattress; and said upper rail having a first strap for supporting a pad upon which a patient's chin rests, said strap laterally adjustable in connectors attached on said rail whereby the vertical distance from the mattress to the strap may be set; said upper rail having a second strap for supporting a pad upon which a patient's forehead rests, said strap laterally adjustable in connectors attached to said rail, and said connectors longitudinally adjustable on said rail whereby the vertical distance from the mattress to the strap may be set, and whereby the distance between the first strap and the second strap may be adjusted; and said pads having hydraulic means to enhance the comfort of a patient while lying in the prone position.

11. An adjustable head support according to claim 10 wherein:

said connectors having securing means for said straps and said rail comprising a unique nut and bolt arrangement.

12. An adjustable head support according to claim 11, wherein:

said bolt has a rounded outer end portion, a threaded shank portion, a reduced portion and an arrow-like end portion, and said nut has a threaded bore to receive the threaded shank portion, a chamber to receive the reduced shank portion and arrow-like end portion, and means extending into said chamber behind the arrow-like end portion to ensure that the bolt cannot be completely turned out of the nut.

13. An adjustable head support according to claim 12 wherein:

said means extending into said chamber comprises a set-screw.

14. An adjustable head support according to claim 12, wherein:

said means extending into said chamber comprises a taut wire.

* * * * *